US005197388A

United States Patent [19]

Keast et al.

[11] Patent Number: 5,197,388

[45] Date of Patent: Mar. 30, 1993

[54] CLAMPING APPARATUS

[76] Inventors: Francis E. Keast, 2 Ellice Street, Embleton, Western Australia 6062; Nigel A. Tucker, 39 Church Street, Wanneroo, Western Australia, 6065, both of Australia

[21] Appl. No.: 747,014

[22] Filed: Aug. 19, 1991

[30] Foreign Application Priority Data

Aug. 20, 1990 [AU] Australia ..... PK1824

[51] Int. Cl.[5] ..... B41F 1/28

[52] U.S. Cl. ..... 101/474; 101/126; 101/35; 261/59

[58] Field of Search ..... 101/114, 126, 35, 407.1, 101/474, 41; 269/58, 59, 289 R; 29/283

[56] References Cited

U.S. PATENT DOCUMENTS 639,623 12/1899 Smith ..... 101/126

2,246,000 6/1941 Pollard ..... 101/126

3,242,859 3/1966 Avgerinos et al. ..... 101/407.1

FOREIGN PATENT DOCUMENTS 0631363 11/1978 U.S.S.R. ..... 101/114

*Primary Examiner*—Edgar S. Burr

*Assistant Examiner*—Christopher A. Bennett

*Attorney, Agent, or Firm*—John S. Hale

[57] ABSTRACT

A clamping apparatus (10) for use in screen printing of curved articles comprising a housing (12) having mounted thereon a holding device (14). In a preferred embodiment the holding device (14) in its operative position is supported by an arm (34) and a post (78). A cable (236) is used to move the post (78) pivotally so as to move the holding device (14) to an inoperative position through an overcenter position. The holding device (14) can be restored to its operative position manually.

7 Claims, 4 Drawing Sheets

CLAMPING APPARATUS

FIELD OF THE INVENTION

The present invention relates to a clamping apparatus. More particularly, but not exclusively, the present invention relates to a clamping apparatus for assisting in the screen printing of an article.

Screen printing is a widely known process and has been used extensively to print patterns or marks on different items. A problem that exists with screen printing is that it is difficult to screen print curved surfaces. This becomes more of a problem if several colours are required to be printed.

At present, when a curved surface of an article is required to be screen printed, the article is typically glued down to a flat surface. This is not very convenient and fresh coats of glue have to be applied from time to time as the coating of glue looses its effectiveness.

SUMMARY OF THE INVENTION

The present invention provides a clamping apparatus which renders a curved surface flat and easy to screen print. In accordance with one aspect of the present invention there is provided a clamping apparatus comprising a first plate and a second plate, the first plate containing an aperture and the first and second plates being arranged to be moved relative to one another between engaged and disengaged positions, such that when the second plate is in engagement with the first plate the aperture in the first plate is closed off so that an article may be clamped between the first and second plates with a portion of the article exposed through the aperture of the first plate.

BRIEF DESCRIPTION OF THE DRAWINGS

The present invention will now be described, by way of example, with reference to the accompanying drawings, in which.

DESCRIPTION OF THE PREFERRED EMBODIMENT

Figure 3:
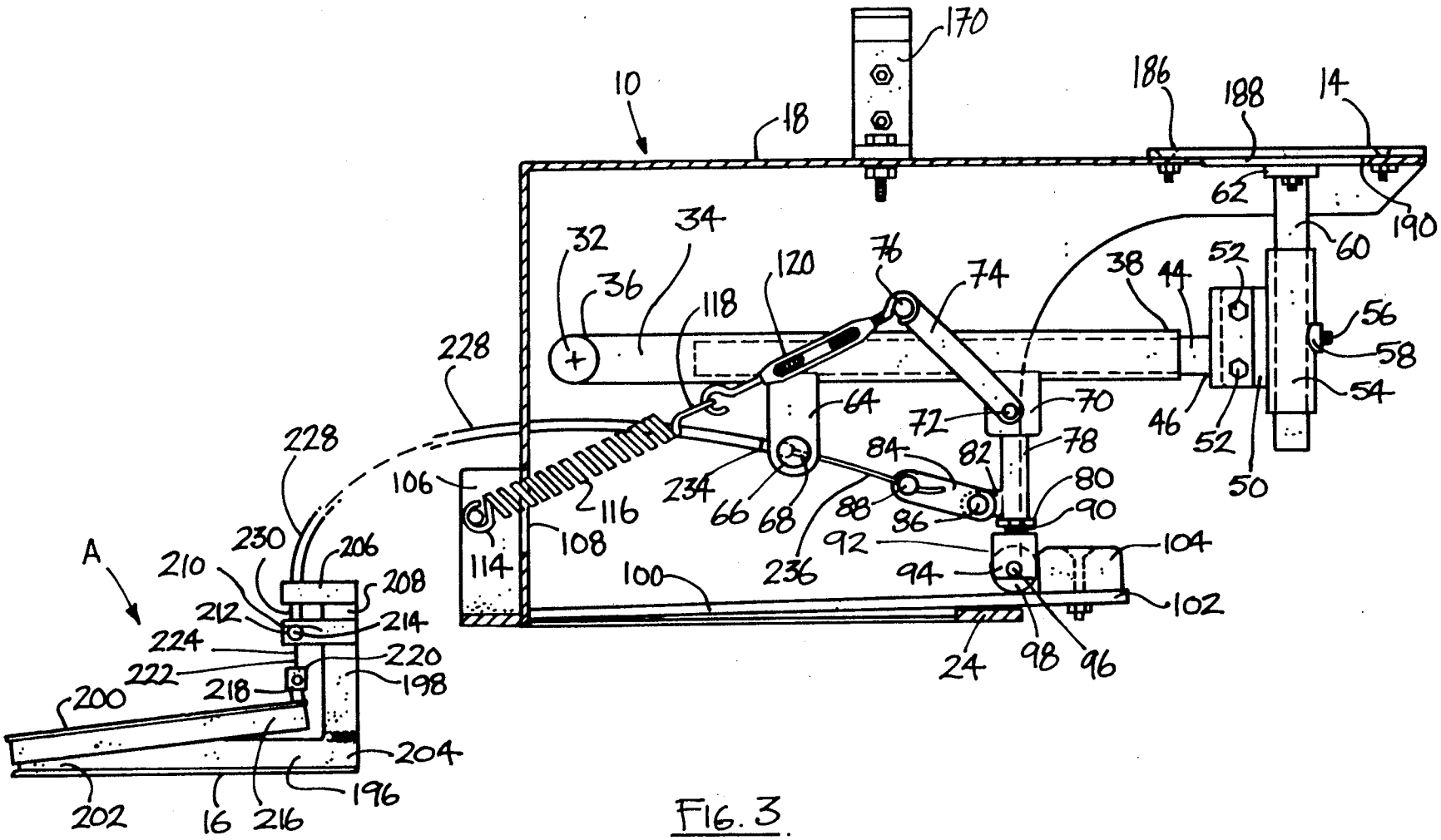
FIG. 3 is a sectional view of the clamping apparatus of FIG. 1 along the line A—A of FIG. 2 showing the clamping apparatus in a closed state.

In the drawings there is shown a clamping apparatus 10 comprising a housing 12, holding means 14 and a pressure actuated switch 16 (see FIG. 3).

The housing 12 has a top 18, sides 20 and a rear 22. The housing 12 has an open lower end and an open front. A cross member 24 extends across the housing 12 and interconnects the side walls 20 at their lower ends at a point remote from the rear wall 22.

Adjacent the rear face 22 each side wall 20 contains a respective threaded aperture in which is located a threaded grub screw 26. The threaded apertures are so disposed that the grub screws 26 are aligned with one another. Each grub screw 26 has mounted thereon externally of the respective side 20 and contiguous thereto a washer 28. Located externally of each washer 28 is a respective lock nut 30 which is threadedly engaged with the grub screw 26.

Figure 2:
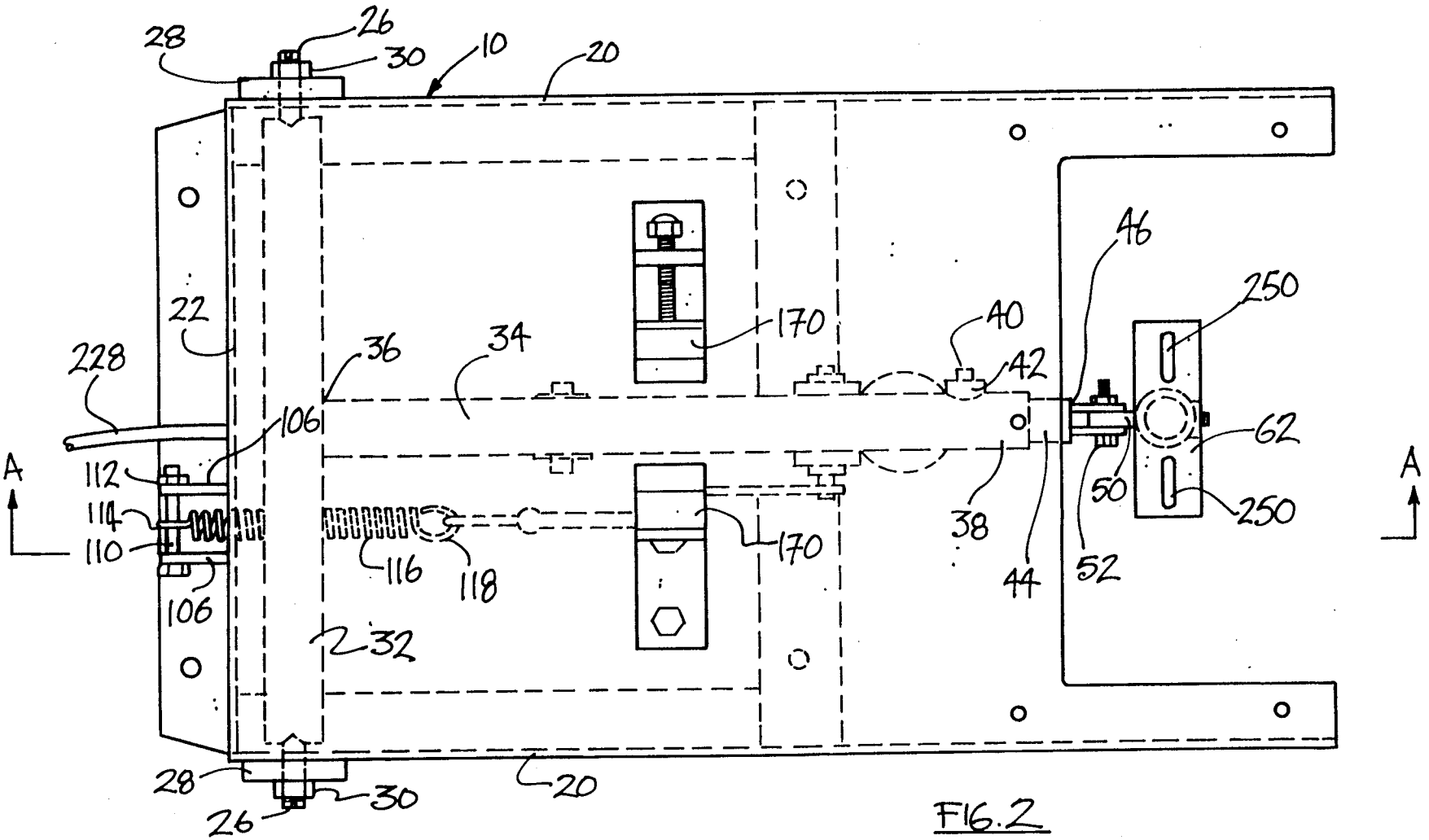
FIG. 2 is a plan view of the clamping apparatus of FIG. 1 with a holding means removed for greater clarity.

Each grub screw 26 extends through the respective aperture and projects into the interior of the housing 12 as can best be seen in FIG. 2. A solid bar 32 is disposed between the grub screws 26. Each grub screw 26 engages with a recess drilled in the adjacent end of the solid bar 32.

The solid member 32 is mounted on the grub screws 26 so as to be able to rotate about its longitudinal axis. If there is any slackness in the mounting of the solid bar 32 such as may be caused by wear, the lock nuts 30 can be loosened to enable the grub screws 26 to be tightened to eliminate the slackness. The grub screws 26 may then be fixed in position by retightening the lock nuts 30.

Fixedly connected to a point substantially midway along the length of the solid bar 32 and extending orthogonally therefrom is a hollow arm 34. The arm 34 has a first end 36 and a second end 38. The arm 34 is disposed centrally between the sides 20 and has the second end 38 thereof disposed substantially adjacent the ends of the sides 20 remote from the rear 22.

A small aperture (not shown) containing a screw thread is disposed at the second end 38 of the arm 34. A grub screw 40 is threadedly engaged with the aperture. The grub screw 40 is also threadedly engaged with a nut 42 which is affixed by any suitable means such as welding to the arm 34. A member 44 of circular cross section engages with the hollow arm 34 so that the main portion of the body thereof is disposed within the hollow arm 34. The member 44 is capable of slidable and rotational movement within the hollow arm 34.

Depending from an end 46 of the member 44 are two small rectangular plates 48. The plates 48 each contain two apertures (not shown). A further small rectangular plate 50 is disposed between the plates 48 (see FIG. 2). The plate 50 also contains two apertures (not shown) which correspond to the apertures in the plates 48. the plates 48 and 50 are connected together by way of nuts and bolts 52 which extend through the corresponding apertures in each of the plates 48 and 50. Preferably, one or both of the apertures in the plate 50 are enlarged to enable a tube member 54 to be described to be pivoted relative to the plates 48 for fine angular adjustment of the apparatus if required.

The plate 50 is fixedly connected to a side of the tube member 54. The tube member 54 contains a threaded aperture (not shown) located substantially midway along the length thereof. A grub screw 56 is threadedly engaged with the aperture in the tube member 54. A nut 58 which is affixed to the tube member 54 by any suitable means such as welding, is threadedly engaged with the grub screw 56. The grub screw 56 may be inserted through the aperture in the tube member 54 until a shaft 60 (see FIGS. 3 and 4) to be described is engaged so as to fix the position of the shaft 60 relative to the tube member 54.

The shaft 60 is of circular cross section and extends through the tube member 54. The main portion of the body of the shaft 60 is disposed inside the tube member 54. The shaft 60 is capable of sliding and swivelling movement within the tube member 54. An upper end of the shaft 60 is fixedly connected to a flat member 62 at a point substantially midway along the length thereof. Fixedly connected to and depending from a point substantially a third of the way along the length of the hollow arm 34 from the end 36 thereof are a pair of parallel arms 64 as shown in FIG. 3. At a lower end thereof, the arms 64 contain respective aligned apertures 66. A pin 68 having an aperture located substantially midway along the length thereof extends through the apertures 66. The aperture in the pin 68 is disposed between the arms 64. Connected to and depending from a point substantially two thirds of the way along the length of the hollow arm 34 from the end 36 thereof is a pair of parallel plates 70 (as shown in FIG. 3). The plates 70 contain respective, aligned apertures (not shown). A shaft 72 extends through the apertures in the plates 70. A tensioning arm 74 extending generally upwards is fixedly connected to an end of the shaft 72.

The arm 74 has a laterally projecting lug 76 at the end thereof remote from the shaft 72. The shaft 72 can rotate with respect to the plates 70, but extends through and is connected to an upper end of a post 78. Hence, when the shaft 72 rotates, the post 78 is pivotally moved. The post 78 contains an internal, threaded aperture extending upwardly from the lower end thereof.

Located adjacent the lower end of the post 78 is an apertured lug 82. A connector 84 having an aperture at one end thereof is connected to the lug 82 by way of a pin 86. The pin 86 extends through the respective apertures in the connector 84 and the lug 82 rendering the connector 84 pivotally movable in relation to the lug 82. At an opposite end of the connector 84 remote from the lug 82 there is a further aperture. An apertured pin 88 extends through the further aperture.

A threaded stud 90 is fixedly connected to an inverted U-shaped member 92 having apertured legs 94. A shaft 96 extends through the apertures in the legs 94. The shaft 96 also extends through a roller 98 disposed between the legs 94 of the member 92 as shown in FIG. 3. The stud 90 is threadedly engaged with the internal aperture in the post 78 until the roller 98 is at a desired location. The roller 98 is retained in the desired position by a lock nut 80. The position of the roller 98 can be readily adjusted by slackening the lock nut 80, rotating the post 90 so as to alter the position of the post 90 relative to the arm 78 and then retightening the lock nut 80.

A longitudinally extending bar 100 extends from the rear 22 of the housing 12 parallel to and mid way between the sides 20. The bar 100 is disposed directly beneath the roller 98. An end 102 of the bar 100 remote from the rear 22 sits on the cross member 24.

Figure 4:
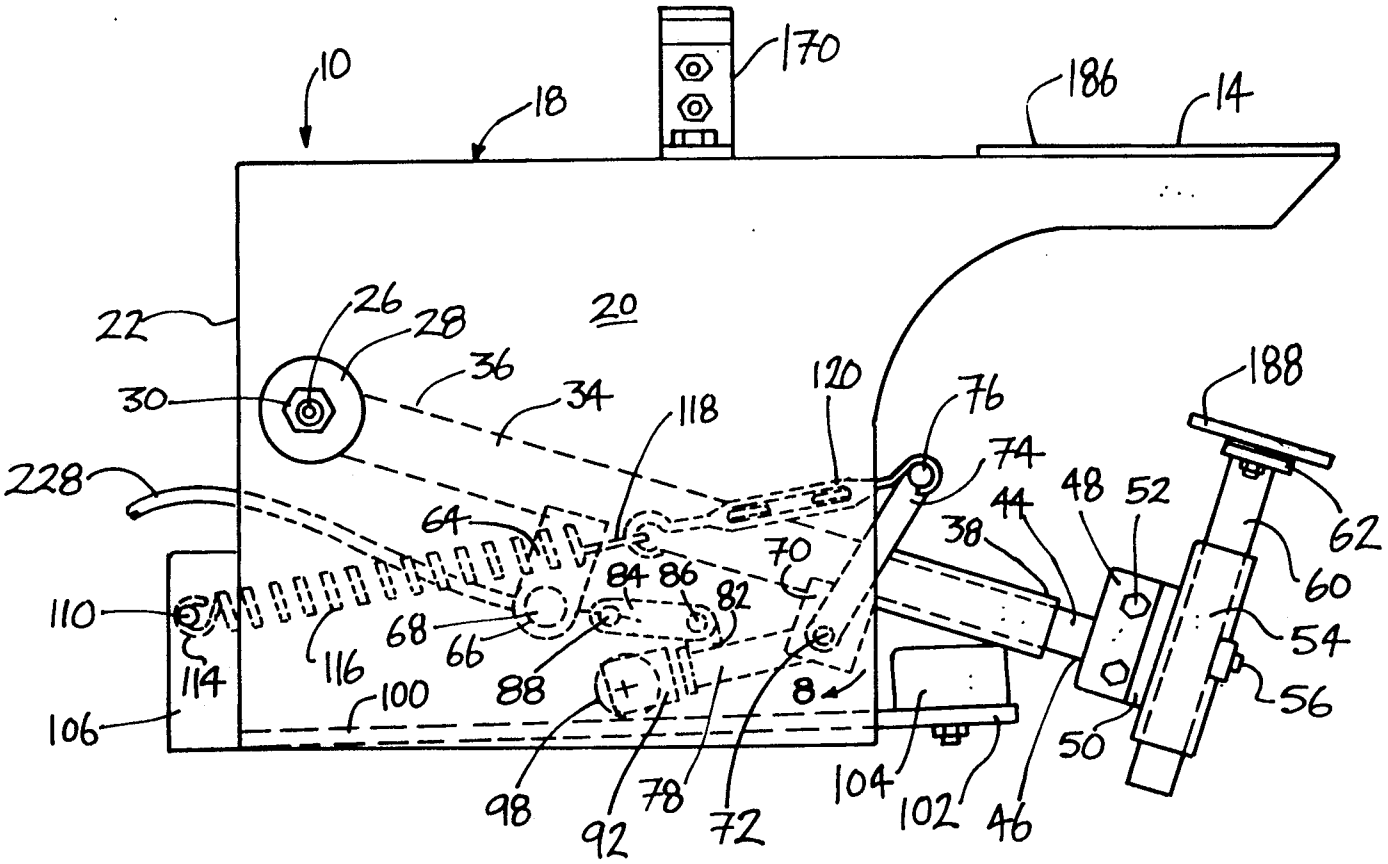
FIG. 4 is a side view of the clamping apparatus of FIG. 1 showing the clamping apparatus in an opened state.

The bar 100 is slightly upwardly inclined to the horizontal to the right as seen in FIGS. 3 and 4.

Connected to the end 102 is a resilient stop 104. The stop 104 extends upwards from the bar 100.

Further, there is connected to the rear 22 externally thereof a pair of rearwardly extending plates 106. Also, the rear 22 contains an aperture 108 (see FIG. 3) between the plates 106.

The plates 106 are apertured and a hexagonal headed bolt 110 threadedly engaged with a nut 112 extends between the apertures in the plates 106.

A hook 114 disposed at an end of a coil spring 116 hooks around the bolt 110. The coil spring extends through the aperture 108. At an opposite end of the coil spring 116 there is disposed a further hook 118. A first end of a tensioning member 120 hooks onto the hook 118. A second end of the tensioning member 120 hooks onto one of the lugs 76 disposed on the tensioning arm 74.

Figure 1:
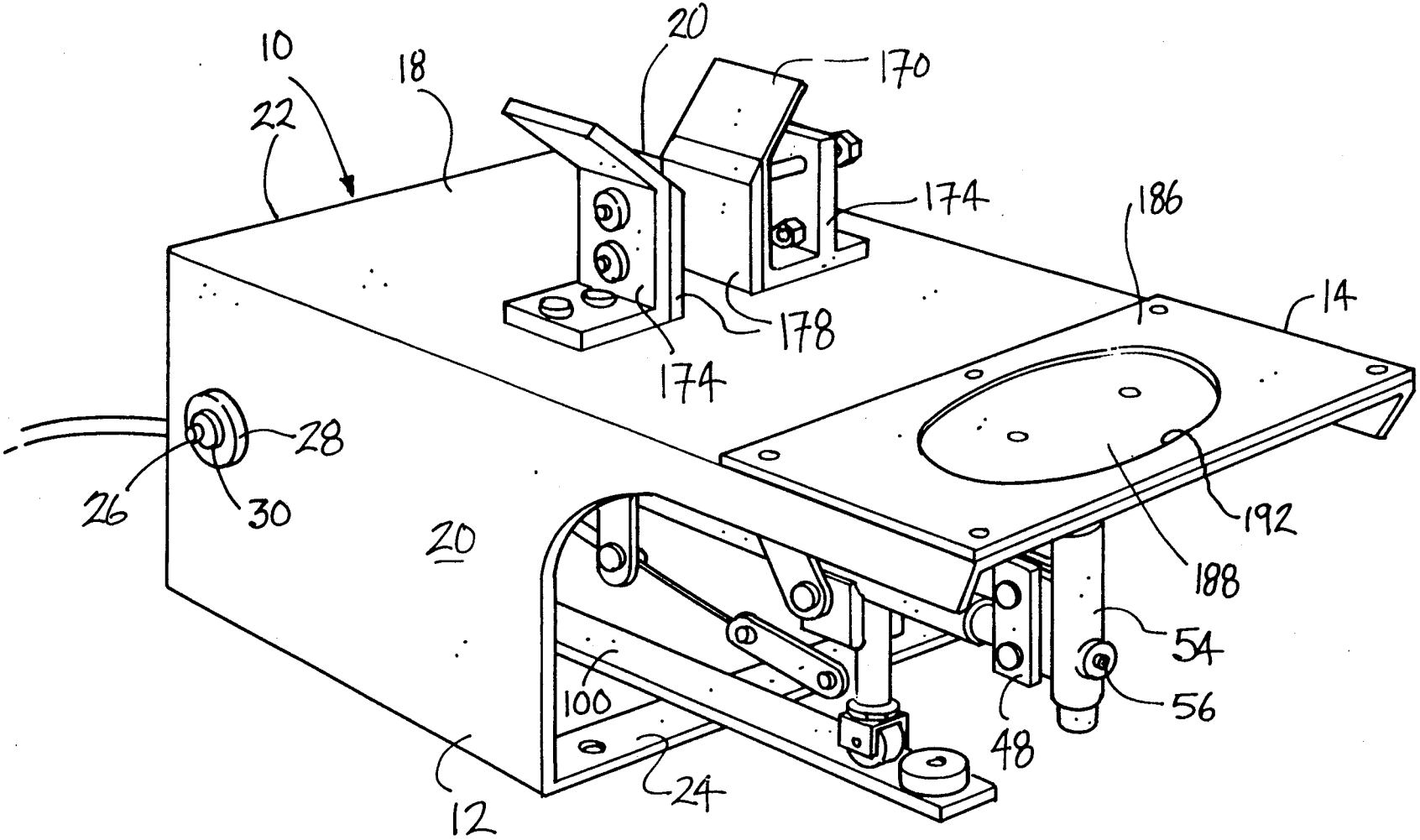
FIG. 1 is an upper perspective view of a clamping apparatus in accordance with the present invention.

Disposed on the top 18 of the housing 12 is a guiding member 170 which acts as a registration device as will be described. The guiding member 170 is mounted to the top 18 by nuts and bolts. The guiding member 170 comprises two rigid arms 174 which extend upward from the top 18. The right hand portion of the guiding member 170 as seen in FIG. 1, is adjustable. In this connection the right hand portion comprises a relatively thin upstanding portion 175 which is integrally formed with the remainder of the guiding member 170. A bolt 176 is threadedly engaged with the respective arms 174 and bears against the portion 175. A pad 178 is disposed on the interior of the left hand arm 174 as shown in FIG. 1 and the interior of the portion 175 also as shown in FIG. 1. The pads 178 are connected by way of pins.

The portion 175 is normally upright as shown in FIG. 1. However, if it is desired to adjust the gap between the two parts of the guiding member 170 then the portion 175 can be tilted inwardly by turning the bolt 176 so as to cause it to bear on the portion 175. The adjustment of the guiding member 170 enables any wear in the pads 178 to be compensated for so that the gap between the two portions of the guiding member 170 remains substantially constant. The holding means 14 comprises a thin flat upper plate 186 and a flat lower plate 188. The upper plate 186 is fixed to the top 18 by way of nuts and bolts as best seen in FIG. 3. Further, the upper plate 186 is fitted about an aperture 190 (see FIG. 3) in the top 18 which is dimensioned and located to receive the flat lower plate 188 in use. The upper plate 186 also comprises a large cut away section 192. The lower plate 188 is fixed to the flat horizontal member 62 connected to the upper end of the shaft 60. The lower plate 188 is smaller in size than the upper plate 186, but larger in size than the cut-away section 192. The lower plate 188 is disposed directly beneath the cut-away section 192 of the upper plate 186 so as to close off the cut-away section 192 in the position of the apparatus 10 shown in FIGS. 1 and 3.

As can best be seen in FIG. 3 the post 78 is connected to the arm 34 at a point close to the holding means 14 than the solid bar 32.

The pressure actuated switch 16 shown in FIG. 3 comprises a base member 196, a vertical member 198 and a flat upper plate 200. The base member 196 has a first end 202 and a second end 204. The vertical member 198 is connected to and extends upward from the second end 204.

A horizontal rigid section 206 is fixedly connected to an upper end 208 of the vertical member 198. The section 206 contains an aperture therethrough (not shown). A pair of spaced lugs 210 are connected to a point adjacent the end 208 of the vertical member 198. The lugs 210 are disposed directly beneath the section 206.

The lugs 210 contain apertures therein. A pin 214 containing a small aperture substantially midway along the length thereof extends through the apertures in the lugs 210 which apertures are aligned. The flat plate 200 is pivotally connected to the first end 202 of the base member 196.

The flat plate 200 is slightly inclined to the horizontal and can pivot in relation to the first end 202 of the base member 196. At an end 216 of the plate 200 there is mounted a retaining member 218. At an upper end 220 of the retaining member 218 there is disposed an aperture (not shown).

A first end 222 of a Bowden cable 224 is provided with a lug 226. The lug 226 is received in the retaining member 218. The cable 224 passes through the aperture (not shown) in the upper end 220 of the retaining member 218 and also through the aperture (not shown) in the pin 214. The cable 224 is provided with a cable casing 228, the cable 224 extending completely therethrough. A first end 230 of the casing 228 extends through the aperture (not shown) in the horizontal member 206 and sits firmly up against the pin 214.

The cable casing 228 extends through an aperture (not shown) in the rear 22 of the housing 12. A second end 234 of the cable casing 228 sits firmly up against the pin 68. A second end 236 of the cable 224 passes through the aperture in the pin 68. The second end 236 is connected to the member 84 by way of the pin 88.

As shown in FIG. 2, the plate 62 may be provided with laterally extending slots 250. These slots 250 allow for lateral adjustment of the lower plate 188 if required. In use, the clamping apparatus 10 is operated as follows. The grub screw 56 is loosened to allow for adjustment of the height of the lower plate 188 in relation to the upper plate 186. Similarly, the grub screw 40 is loosened to allow for appropriate positioning of the lower plate 188 beneath the cut-away section 192. Once the lower plate has been appropriately positioned, both grub screws 40 and 56 are tightened. In the position shown in FIG. 3, the apparatus 10 is in a very stable condition. The post 78 supports the arms 34 which supports the holding means 14. Downward pressure on the holding means 14 will not dislodge the arm 78 from the upright position shown under normal conditions of use.

FIG. 4 clearly indicates steps by which the holding means 14 of the clamping apparatus 10 may be opened. Pressure is applied down onto the upper plate 200 of the switch 16. The upper plate 200 pivots at the first end 202 of the base member 196 as shown by arrow A in FIG. 3.

Since both ends 230 and 234 of the cable casing 228 sit firmly up against pins 214 and 68 respectively, the cable 224 is pulled so that it slidably moves within the casing. The cable 224 is connected to the connecting member 84 and hence this member 84 is also pulled.

The member 84 is also connected to the post 78 adjacent the lower end thereof, and hence the lower end of the post 78 is pulled back about the shaft 72 and made to pivot as indicated by arrow B in FIG. 4. As the post 78 is pulled back, the roller 98 proceeds to roll along the bar 100 in a direction that is towards the rear 22. As the post 78 pivots, the tensioning arm 74 pivots in a clockwise direction about an axis defined by the shaft 72. As it pivots, the tensioning arm 74 stretches the coil spring 116 and places the coil spring 116 in a state of tension. The amount of tension on the coil spring 116 can easily be controlled by adjusting the tensioning means 120 in known manner. As can be seen in FIGS. 3 and 4, the post 78 pivots from a substantially upright position when the arm 34 is in its upper position to a position inclined to the vertical when the arm 34 is in its lower position.

The hollow arm 34 now has nothing supporting it and hence the bar 32, to which it is fixedly connected, rotates on the grub screws 26. As a consequence, the lower plate 188 of the holding means 14 drops down as indicated by arrow C in FIG. 4. Hence, the clamping apparatus 10 is now in an opened state. While the lower plate 188 is away from the upper plate 186, an appropriate item to be printed can be placed on the top of the lower plate 188. The face of side of the article to be printed is positioned so that it faces upwards.

At a certain point on the pivoting of the post 78 and the downward movement of the arm 34 the apparatus passes through an overcentre position. Once past the overcentre position the arm 34 will not return to the position shown in FIG. 3 without application of an upward force from an external source. Thus, the holding means 14 stays open for as long as required without having to be held upon.

Once the apparatus passes through the overcentre position pressure on the switch 16 can be released.

Once an item is correctly positioned on the lower plate 188, the lower plate 188 can be moved to the position shown in FIG. 3 manually. This causes the various components of the apparatus to return to the positions shown in FIG. 3 including the cable 228, the post 78 and the arm 34. Thus, the roller 98 rolls along the flat bar 100 towards the end 102 thereof. The roller 98 eventually comes into contact with the resilient stop 104. At this point, the roller 98 ceases rolling and sits firmly up against the stop 104.

The post 78 is now in a position which is vertical or slightly inclined to the vertical.

The hollow arm 34 pivots about an axis defined by the grub screws 26 and the solid bar 32 and adopts a substantially horizontal disposition as shown in FIG. 3. The lower plate 188 which now has the item thereon contacts the upper plate 186.

The stop 104 and the tension of the spring 116 cause the roller 98 and the arm 78 and hence the hollow arm 34 to be locked into position. This in turn causes the lower plate 188 to be held firmly up against the underside of the upper plate 186. The holding means 14 is hence in a closed state. The item to be printed is disposed in the cut-away section 192 with the appropriate face or side to be printed facing upwards.

The holding means 14 is substantially locked into a closed state. As the roller 98, the post 78 and the hollow arm 34 are locked into position the lower plate 188 will not drop down even if substantial pressure is applied thereon. FIG. 3 clearly shows the clamping apparatus 10 in the closed state.

An appropriate printing carousel is connected to the clamping apparatus 10 by way of the guiding member 170 which serves to register correctly the carousel. The item in the holding means 14 can then be screen printed repeatedly, as many times as is desired, without the need to open the clamping apparatus 10.

Once screen printing of the item has been completed, the clamping apparatus 10 is opened by again applying pressure down onto the upper plate 200 of the switch 16. The clamping apparatus is then moved back to the open state as can be seen in FIG. 4. The item that has been screen printed can then be removed. If desired, another item can then be placed on the top of the lower plate 188 and the above process can be repeated.

By use of the present invention, the item to be printed is easily printed several times. The apparatus of the present invention is particularly suited to meticulous work. Curved surfaces thereof may be held in a flat position in a distortion free manner. The lower plate 188 does not collapse while printing is taking place due to it being locked into position by the components beneath it.

It is to be appreciated the holding means 14 can assume different sizes, shapes and depths and even be disconnected and replaced with a different holding means.

It has been found that the apparatus of the present invention is particularly efficacious in screen printing of flexible but inherently curved articles such as front bridges of caps.

Modifications and variations such as would be apparent to a skilled addressee are deemed within the scope of the present invention.

For example, the plate 188 could be fixed in position whilst the upper apertured plate 186 is movable into engagement with the plate 186. The members 186 or 188 could, where movable, be arranged for hydraulic or pneumatic actuation or be cam operated or be operated by any other convenient means.

We claim:

1. A clamping apparatus comprising;

a holding means having a first, upper, stationary plate and a second, lower, moveable plate;

said first plate including an aperture;

said aperture having a continuous, endless boundary and being contained wholly within said first plate;

support means for mounting said second plate;

said support means including means for enabling said second plate to move reciprocally between a first position in which said second plate is engaged with said first plate and a second position in which said second plate is disengaged from said first plate;

said second plate being of larger size than said aperture of said first plate so that, when said second plate is in said first position, said second plate closes off said aperture;

said support means further including means for locking said support means against downward pressure on said second plate when said second plate is in said first position and for holding said second plate in said second position without the need for application of external force when said second plate is in said second position.

2. A clamping apparatus comprising;

a holding means having a first, upper, stationary plate and a second, lower, moveable plate;

said first plate including an aperture;

said aperture having a continuous, endless boundary and being contained wholly within said first plate;

support means for mounting said second plate;

said support means including means for enabling said second plate to move reciprocally between a first position in which said second plate is engaged with said first plate and a second position in which said second plate is disengaged from said first plate;

said second plate being of larger size than said aperture of said first plate so that, when said second plate is in said first position, said second plate closes off said aperture;

said support means comprising a pivotally mounted arm which is arranged to pivot between a first, upper position in which the second plate is in engagement with the first plate, and a second, lower position in which the second plate is disengaged from the first plate;

said pivotally mounted arm including a depending post having an upper end and a lower end, the upper end of said post being pivotally connected to said arm; said post being substantially vertically upright when said arm is in the first, upper position and inclined to the vertical when said arm is in the second, lower position;

said depending post further including a roller at the lower end thereof; and, said holding means includes a bar on which said roller rides as the post moves between the substantially vertically upright position and the included position.

3. A clamping apparatus according to claim 2 wherein the bar is provided with a stop with which the roller engages when the post is in the substantially upright position.

4. A clamping apparatus according to claim 2 including a tensioning arm, connected to the upper end of the post, said tensioning arm pivoting with the post, the tensioning arm being in an unstressed position when the post is upright and being in a stressed position when the post is inclined to the vertical.

5. A clamping apparatus according to claim 2 including switch means for pivoting the post away from the substantially upright position.

6. A clamping apparatus according to claim 2 wherein, when the pivotally mounted arm is in the first upper position, the support means is arranged to be locked in position such that downward pressure on the second plate will not cause disengagement of the first and second plates under normal conditions of use, and, when the pivotally mounted arm is in the second lower position, the support means is so arranged that the second plate remains in the second position without the need for application of external force.

7. A clamping apparatus according to claim 2 including a guiding member for holding a screen mounting carousel.

* * * * *